United States Patent [19]

Bartos et al.

[11] 4,059,123

[45] Nov. 22, 1977

[54] CLEANING AND PRESERVATION UNIT FOR TURBINE ENGINE

[75] Inventors: Joseph S. Bartos; Robert J. St. Onge, both of Trumbull, Conn.

[73] Assignee: Avco Corporation, Stratford, Conn.

[21] Appl. No.: 733,627

[22] Filed: Oct. 18, 1976

[51] Int. Cl.[2] ..... B08B 3/02; B08B 3/10; F04B 21/00

[52] U.S. Cl. ..... 134/102; 60/39.33; 134/167 R; 134/169 A; 222/136; 417/234; 415/219 R

[58] Field of Search ..... 417/364, 234; 222/136, 222/61, 396; 134/167 R, 169 A, 168 R, 171, 102, 104; 60/39.33

[56] References Cited

U.S. PATENT DOCUMENTS

| | | | |
|---|---|---|---|
| 2,599,560 | 6/1952 | Ketterer | 222/136 X |
| 2,689,456 | 9/1954 | White | 60/39.33 |
| 3,335,916 | 8/1967 | Juniper | 222/399 X |
| 3,567,342 | 3/1971 | Jackson | 417/364 |
| 3,797,744 | 3/1974 | Smith | 134/102 |

FOREIGN PATENT DOCUMENTS

| | | | |
|---|---|---|---|
| 280,072 | 8/1966 | Australia | 134/169 A |
| 1,254,163 | 1/1961 | France | 417/364 |

*Primary Examiner*—Carlton R. Croyle
*Assistant Examiner*—Richard E. Gluck
*Attorney, Agent, or Firm*—Irwin P. Garfinkle; Robert J. McNair, Jr.

[57] ABSTRACT

A mobile cart-mounted unit for cleaning and preserving turbine engines comprises pressurized reservoirs for holding the solvent, cleaner, preservative and water. Pressurization is achieved by use of an integrally mounted air compressor driven by an internal combustion engine. The engine also powers an alternator which is used to charge a storage battery. The storage battery serves as an energy source to crank the turbine to approximately 10 percent rated speed during the cleaning and preservation servicing sequence. A control console provides the operator with the needed valves, gages and meters with which to operate the unit.

6 Claims, 6 Drawing Figures

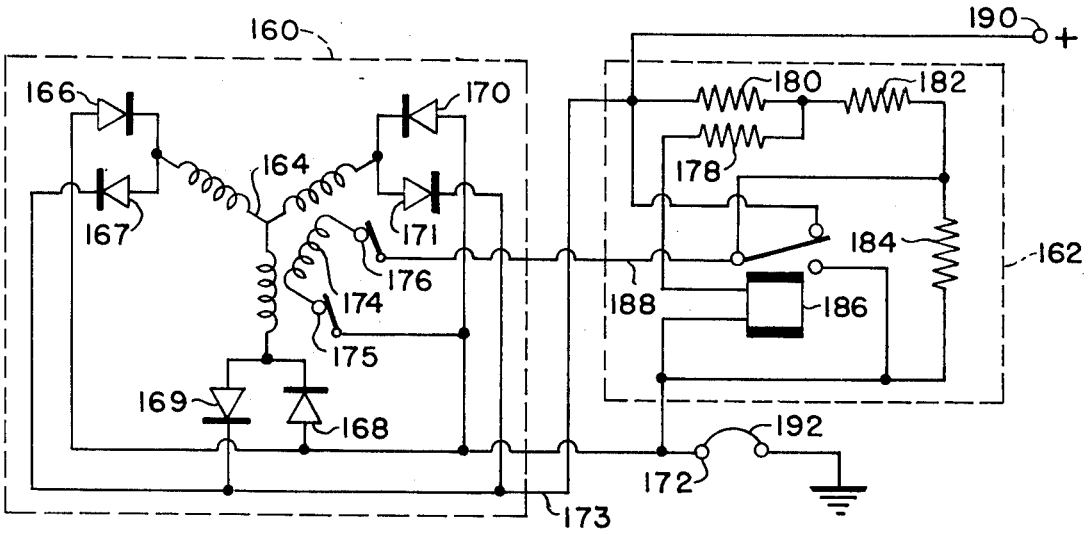
Fig 4
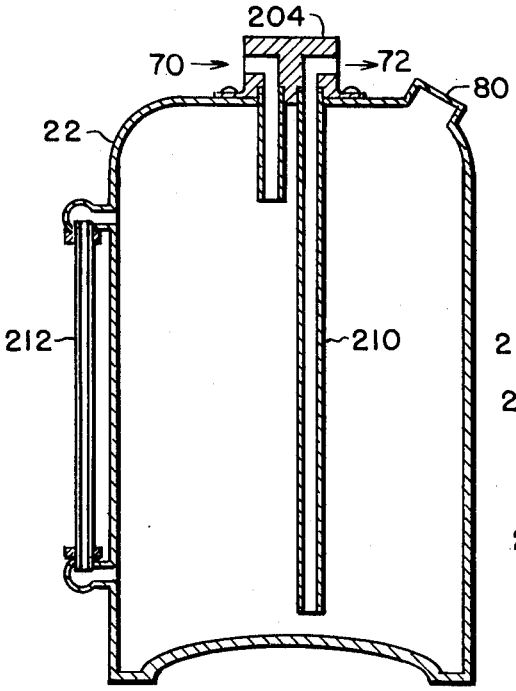
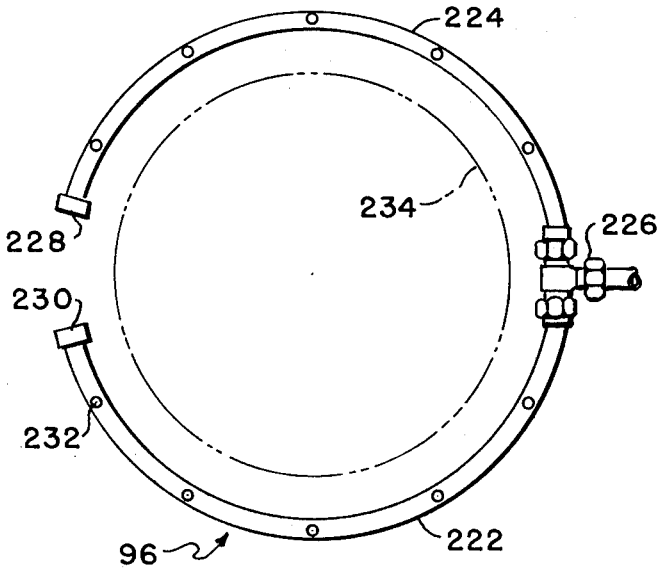
Fig 5
Fig 6

CLEANING AND PRESERVATION UNIT FOR TURBINE ENGINE

BACKGROUND OF THE INVENTION

This invention provides means for cleaning gas turbine engines which are called upon to operate in dusty and particle contaminated enviroments. To operate efficiently such engines must be cleaned after every 50 to 100 hours of use. The cleaning and preservation unit herein disclosed consists of one large and three medium size reservoirs, a control console, a mobile handrawn cart, a gasoline engine powered air compressor, and all required interconnecting plumbing. Also included are five air pressure regulators, with integral pressure gages. One regulator is located in the main air supply line coming from the large air/water reservoir and three regulators are located in the air supply lines to the medium size reservoirs. The air system incorporates a regulated air source for operator use which draws air from the main air supply line between the main air pressure regulator and manifold. The main air supply line contains the fifth air pressure regulator, gage, and a check valve. The portable cleaning and preservation unit incorporates an auxiliary electrical power system to provide a means of supplying electrical power to engine starters. This allows the turbine engine to be run up and motored during the cleaning operation, thus assuring thorough penetration of the cleaning and preservation solutions into all parts and chambers.

Cleaning and preservation units have been configured before. The early units did not have an air compressor but made use of prepressurized air bottles to acutate the system. When it was found that the turbine had to be spinning for proper cleaning of the engine, this was done by cranking from either the internal aircraft battery or from an auxiliary battery cart. Neither of these approaches allowed the cleaning operation to proceed on a coordinated basis. Our invention makes it possible to control the whole cleaning and preservation sequence from one console. All equipment needed to carry out the task is contained in a single self-powered unit.

SUMMARY OF THE INVENTION

A self-contained turbine engine cleaning and preservation unit is disclosed. The entire unit is mounted on a hand-drawn cart. Included on the cart are: a large reservoir two-thirds filled with water, a reservoir containing solvent, a reservoir containing a cleaning solution, a reservoir containing a preservation solution for protecting the engine parts from rust, an air compressor for pressurized air being stored in the top part of the reservoir that is partially filled with water, an internal combustion engine for driving the compressor, an alternator also powered by the internal combustion engine, said alternator being used to charge a storage battery, the battery being of sufficient capacity to crank a turbine engine which is in need of cleaning, and a control console having a multiplicity of gages, valves and meters adequate to allow an operator to conduct the engine cleaning and preservation sequence. Also included with the unit are the electrical cables, high pressure hoses and nozzles which convey both fluid and battery energy to the turbine engine undergoing the clean-up sequence.

By having a single composite self-powered mobile unit, the cleaning sequence can progress in an optimized manner. Specific instructions can be prepared for each model engine by detailing the valve settings, gage readings and duration needed to accomplish a thorough cleaning operation.

BRIEF DESCRIPTION OF THE DRAWINGS

FIG. 4 is a schematic of the alternator and associated voltage regulator;

FIG. 5 is a cross-sectional view of the cleaning solution storage reservoir; and FIG. 6 is an isometric view of a typical spray manifold.

DESCRIPTION OF THE PREFERRED EMBODIMENT

Figure 1:
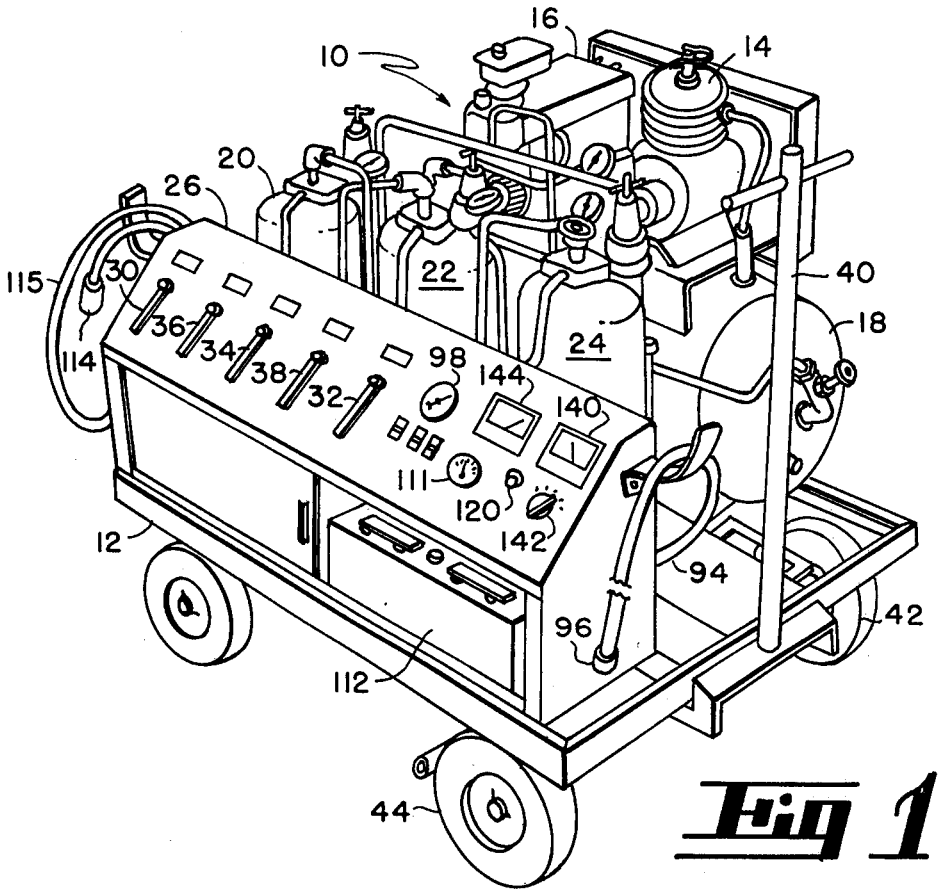
FIG. 1 is an isometric view of the cart-mounted cleaning and preservation unit.

Referring to FIG. 1 there is shown a mobile cart 10 having a frame 12 on which is mounted the several components comprising the cleaning and preservation unit. These include air compressor 14 which is driven by internal combustion engine 16. Air compressor 14 pressurizes water reservoir 18. In the unit reduced to practice water reservoir 18 had a capacity of thirty gallons. No more than twenty gallons of water is placed in reservoir 18 at refill. This provides adequate space within the reservoir for the system pressurizing air. Down the center of the cart is a row of three like sized five gallon reservoirs. Reservoir 20 contains preservative. Reservoir 22 contains cleaner. Reservoir 24 contains solvent. Console 26, along the left side of the cart as viewed in FIG. 1, contains all of the control valves and gages needed by the operator. A shelf inside console 26 provides space for storage battery 112 which is used in cranking the engine during the cleaning sequence.

Ball valves along the upper left section of the operator's console provide functions as follows: air purge valve 30, water valve 32, solvent valve 34, cleaner valve 36, and preservation valve 38.

A T-handle steering bar 40 at the front of the cart makes it possible for the operator to move the cart into position for servicing an engine. There is a mechanism (not shown) which clamps against wheels 42 and 44 to prevent their turning when T-handle steering bar 40 is raised to an upright position.

Figure 2:
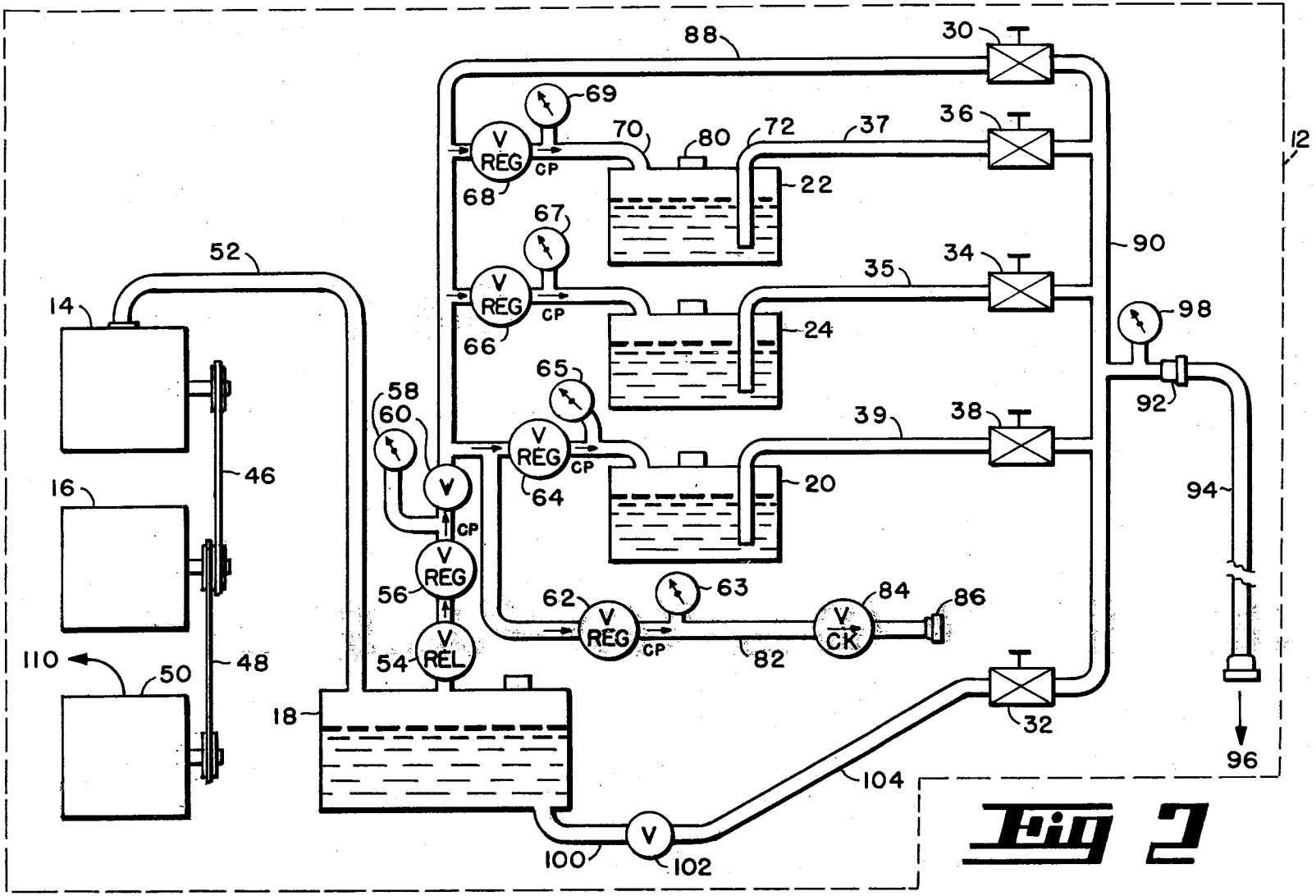
FIG. 2 is a block diagram of the pressurized fluid portion of the cleaning and preservation unit.

Compressor 14 is belt driven from engine 16. This is shown in FIG. 2 where V-belt 46 drives compressor 14. Engine 16 also drives via V-belt 48 an alternator 50 which serves to charge storage battery 112 (explained in more detail later).

Air line 52 conveys the output of compressor 14 directly into partially filled water reservoir 18. As the pressure builds up in reservoir 18, relief valve 54 will protect the system. Pressure regulator valve 56 provides a means for setting system pressure to a predetermined value. In the unit reduced to practice, pressure regulators made by C. A. Norgren Co. of Littleton, Colorado were used. The pressure setting of regulator 56 is read from gage 58. A main-air gate valve 60 provides control over the entire system.

At the outlet of gate valve 60, pressure lines carry air to regulators 62, 64, 66 and 68. At the output of each of the regulators there is a pressure gage. These gages have been labeled 63, 65, 67 and 69 in FIG. 2. The outlet of regulator 64 pressurizes reservoir 20 which contains the preservative solution. In a like fashion, regulator 66 pressurizes reservoir 24 containing solvent and regulator 68 pressurizes reservoir 22 which contains the cleaner.

In practice it was found that the following products gave good results:

1. Type B&B 3100 cleaner produced by B & B Chemical Company of Hialeah, Florida
2. Type P-D-680 Solvent known in the dry cleaning industry
3. Type LPS-2 Preservative produced by LPS Laboratories, Inc. of Los Angeles, California Reservoirs 20, 22 and 24 were all alike in the unit reduced to practice. FIG. 5 shows a cross section of one of the 5 gallon sized reservoirs used in the unit reduced to practice. In FIG. 5, reservoir 22 is of the type designed for use at air pressures up to 150 psig. Fittings at the top of the reservoir 22 provide connections for both inlet line 72 and outlet line 74. Line 74 extends inside the reservoir to assure that the liquid contents are forced out during operation. Sight gage 212 (See FIG. 5) is connected to the side of reservoir 22 to allow the operator to check the status of his cleaning system. Filler cap 80 allows easy access to the reservoir for refilling purposes.

Again referring to FIG. 2, there are shown two air pressure lines which do not connect to reservoirs. One of these is the line which comes from regulator 62. Line 82 terminates at check valve 84 from which a utility fitting 86 provides access by the customer to a source of pressurized air. At the top of FIG. 2 is air supply line 88 which carries pressurized air to manually operated ball valve 30. Air flowing through valve 30 is used to purge liquids from system discharge line 90. Fitting 92 at the end of discharge line 90 provides a connection to high pressure flexible hose 94 which conveys the cleaning fluids to the spray manifold 96 (see FIG. 6). Gage 98 provides information on the magnitude of pressure in discharge line 90.

On the bottom or liquid side of water reservoir 18 there is line 100. Gate valve 102 is provided as a shut-off to prevent any flow of water in the system if desired. Line 104 conveys the output of gate valve 102 to manually operated ball valve 32. Manually operated ball valves 34, 36 and 38 are used to control respectively the flow of solvent, cleaning and preservative coming from their individual reservoirs via lines 35, 37 and 39.

Figure 3:
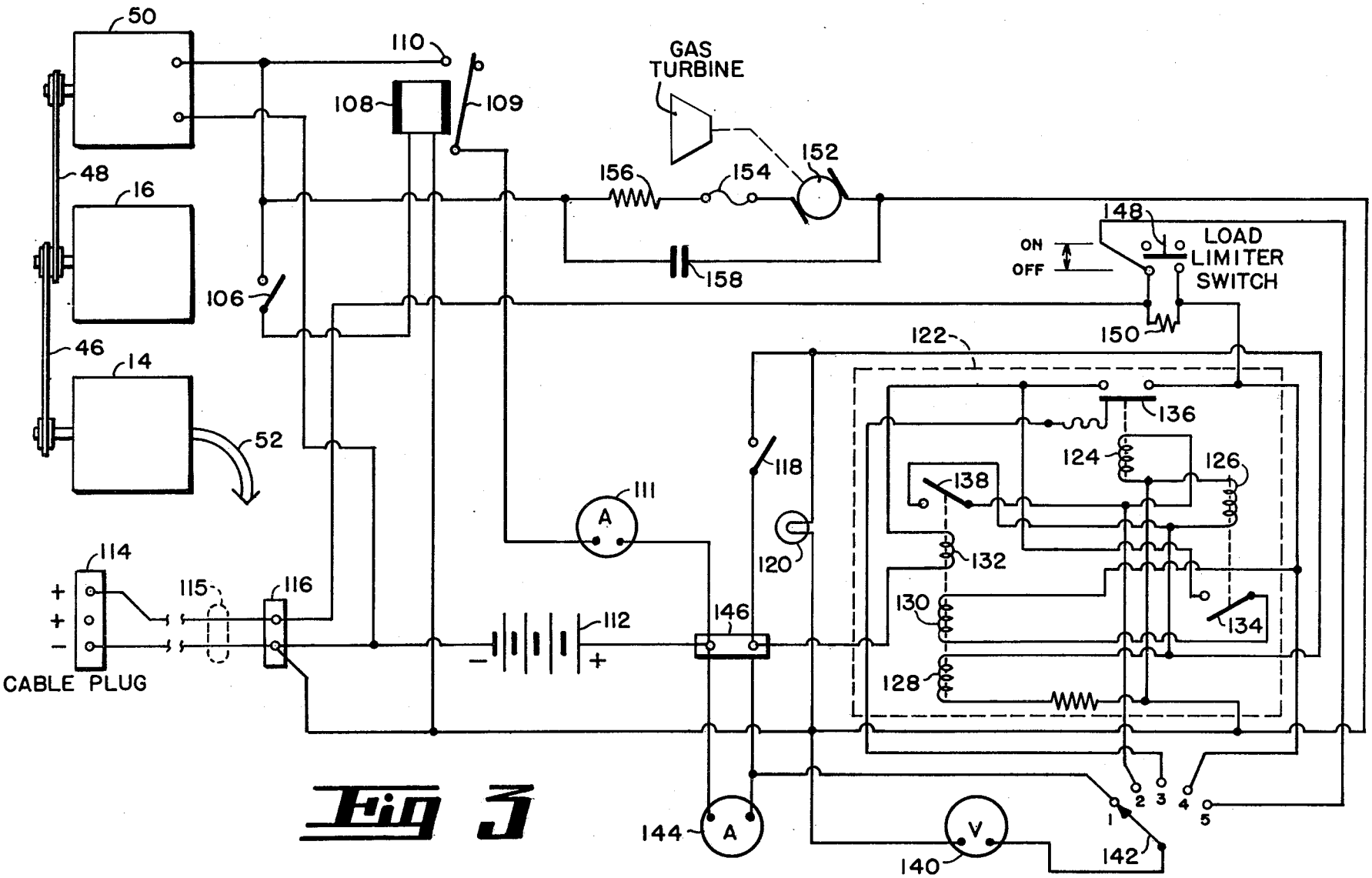
FIG. 3 is a schematic partially in block diagram form of the auxiliary electrical power system which forms a part of the cleaning and preservation unit.

Referring now to FIG. 3 there is shown a schematic of the electrical portion of the cleaning and preservation unit. Internal combustion engine 16 simultaneously drives both air compressor 14 and alternator 50 by means of V-belts 46 and 48. In the unit reduced to practice engine 16 was a Model 130200, manually cranked 5 hp gasoline engine built by Briggs & Stratton Corp., Milwaukee, Wisconsin. The alternator was a Series 10 S unit built by C. E. Niehoff & Co., Chicago, Illinois.

After engine 16 is running at rated speed, battery charge switch 106 is closed. This energizes relay 108, bringing relay contact 109 against switch contact 110. Current from alternator 50 then flows through charge monitoring ammeter 111 and into battery 112. The internal circuitry of alternator 50 together with its associated voltage regulator will be discussed more fully later, in conjunction with FIG. 4.

During the cleaning and preserving sequence, battery 112 is used to crank the turbine engine. This is accomplished by plugging cable plug 114 into the airframe power receptacle. For most applications, cable plug 114 is a Type AN2551. In the unit reduced to practice, a 30-ft. heavy duty electrical cable assembly 115 was used between terminal block 116 and cable plug 114. With cable plug 114 inserted in the airframe power receptacle (not shown), external load switch 118 is closed. This lights load energize lamp 120. Closure of switch 118 also activates circuitry within reverse current relay module 122. In the unit reduced to practice, reverse current relay module 122 was a Type-702 L unit made by The Hartman Electrical Manufacturing Co. of Mansfield, Ohio. The reverse current relay 122 comprises: main contactor relay coil 124; voltage relay coil 126; biasing coil 128, differential coil 130; and reverse current coil 132.

Closure of switch 118 energizes coils 126 and 128. Energizing of coil 126 closes relay contacts 134 which places coil 130 across open contacts 136. Differential coil 130 will prevent coil 128 from closing contacts 138 unless the voltage drop across open contacts 136 is less than 0.5 volts. Assuming the positive aircraft voltage at cable plug 114 is within 0.5 volt of battery 112 voltage, energized coil 128 will close relay contacts 138 causing main contactor coil 124 to become energized, thus closing main relay contacts 136.

Voltmeter 140 and 5-position switch 142 allow monitoring cart system equipment and the functioning of the several components within reverse current relay 122. Ammeter 144 used in combination with current shunt 146 allows monitoring of current flow from battery 112 to the aircraft engine cranking motor. With load limiter switch 148 in the ON position, resistor 150 limits current output from the battery 112 to approximately 650 amps.

If for any reason current from the aircraft tends to flow into instead of out of electrical cable 115, reverse current coil 132 will act to open relay contacts 138 which in turn cause contacts 136 to open. Thus, a reversal of current through cable 115, causes the auxiliary electrical power system to automatically disconnect.

Motor 152 drives a fan blade integrally mounted on the shaft thereof. Motor 152 is encircuited by means of fuze 154, resistor 156 and capacitor 158 such that it serves to purge fumes from the battery compartment whenever alternator 50 operates to charge battery 112.

FIG. 4 is a schematic of the elements contained in the FIGS. 2 and 3 block labeled alternator 50. There are actually two entities, an alternator/rectifier 160 and a voltage regulator 162. Alternator/rectifier 160 comprises a Y-wound stator connected to six diodes 166–171 inclusive. Diodes 166, 168 and 170 connect the 3-legs of the stator to the negative output terminal 172 and diodes 167, 169 and 171 connect the 3-legs to the positive output line 173. Rotating field winding 174 is coupled to the outside circuitry by means of slip rings 175 and 176. Voltage regulator 162 is comprised of resistors 178, 180, 182 and 184 plus relay 186. The regulator serves to energize the field winding of the alternator/rectifier, maintaining the current through the field at a level dependent on the level of charge present in the associated storage battery. In other words, when the voltage difference between terminal 190 and 172 becomes great enough, the current through resistor 180, resistor 178 and the coil of relay 186 increases to the point where the relay is actuated causing the voltage available at field terminal 188 to drop and thus decrease the charging rate of the alternator. Jumper 192 can be connected as shown in FIG. 4 in order to ground the negative output of the alternator to the frame. In the unit reduced to practice jumper 192 was removed so that isolation from ground was achieved.

FIG. 5 shows a cross sectional view of cleaning reservoir 22. Reservoirs 20 and 24 are similar. In the unit reduced to practice reservoir 22 had a capacity of five gallons. Reservoir 22 has a filler cap 80 and an access fitting 204. Fitting 204 has an inlet duct 70 by means of which pressurized air enters the reservoir. There is an outlet duct 72 connected to a vent pipe 210 by means of which pressurized air forces fluid from the reservoir. A glass viewing gage 212 allows the operator to monitor the fluid level in the reservoir.

FIG. 6 shows one type of spray ring assembly which is used to inject fluids into a gas turbine engine. The ring assembly 96 comprises two arcuate tube sections 222 and 224 having threaded fittings on one end which allow attachment to T-section 226. The third opening in T-section 226 attaches via appropriate hardware to the end of high pressure hose 94 (See FIG. 2). The second end of tube sections 222 and 224 are stopped by means of end caps 228 and 230. A multiplicity of holes 232 in the front face of tubes 222 and 224 allow liquid to spray out perpendicular to the plane of the assembly shown in FIG. 6. By means of a supporting structure (not shown) the ring assembly 96 may be clamped in coaxial symmetry with the hub shroud of the turbine engine. The hub shroud is shown by phantom line 234 in FIG. 6. The exact structure used to clamp ring assembly 96 in place will vary from engine to engine since it depends on the configuration of the engine shroud.

While an illustrative embodiment of the present invention has been described, it should be apparent to those skilled in the art that other variations may be utilized without departing from the scope and spirit of the invention. For example, a self starting diesel or gas turbine engine may be used to drive the compressor where fuel logistics indicate an advantage thereto. Also, the cart may be arranged for towing behind a light utility vehicle. Additionally, it may be advantageous in some implementations to use a separate reservoir for storage of pressurized air.

What is claimed is:

1. Apparatus for cleaning and preservation of a gas turbine engine, said engine having a starting motor for cranking the rotary compressor stages thereof, comprising in combination:

a frame structure having supporting wheels journaled for rotation;

a first reservoir mounted on said frame, said first reservoir being partially filled with water;

additional reservoirs for cleaner, solvent and preservative solutions mounted on said frame;

an internal combustion engine, a control console, a rotary air compressor and an alternator also mounted on said frame, said internal combustion engine being drivingly coupled to both said air compressor and said alternator;

an electric storage battery mounted in a compartment of said control console;

electrical connections between said alternator and said battery for charging said battery, said electrical connections including operator-manipulated control means for controlling the energy transfer from said alternator to said battery;

fluid connection means between said air compressor and said first reservoir for pressurizing said first reservoir with a volume of compressed air;

fluid connections between said volume of air and each of said additional reservoirs for pressurizing said additional reservoirs;

manually operable controll means in each of said connections for controlling the pressurization of each of said reservoirs;

nozzle apparatus mountable on said gas turbine engine for spraying the inside thereof with fluids;

means for connecting each of said reservoirs to said nozzle apparatus, said means including a high pressure hose selectively connected to said reservoirs; and encircuiting means including a two-conductor electrical cable connecting said battery to said starting motor for cranking said rotary compressor stages.

2. The cleaning and preservation apparatus as set forth in claim 1 wherein the encircuiting means further comprises a reverse current relay serving to automatically disconnect at least one of said two-conductor cables from said storage battery whenever current flowss reverse in said cable.

3. The cleaning and preservation apparatus as set forth in claim 1 wherein the internal combustion engine is a manually cranked five horsepower gasoline engine.

4. The cleaning and preservation apparatus as set forth in claim 1 wherein the frame structure is supported on four rotatably mounted wheels, one wheel being generally on each corner of said frame structure, the front two of said wheels being arranged for cooperative action with a T-handle steering bar.

5. The cleaning and preservation apparatus as set forth in claim 1 wherein said fluid connections between said volume of air and each of said additional reservoirs includes pressure regulators for adjusting the pressurization level at each reservoir.

6. The cleaning and preservation apparatus as set forth in claim 5 including an air supply line for purging liquids from the means connecting each of said reservoirs to said nozzle apparatus.

* * * * *

UNITED STATES PATENT OFFICE

CERTIFICATE OF CORRECTION

PATENT NO. :4,059,123

DATED :11-22-77

INVENTOR(S) :Joseph S. Bartos and Robert J. St. Onge

It is certified that error appears in the above-identified patent and that said Letters Patent are hereby corrected as shown below:

Col. 1, line 52, after "for" insert -- pressurizing the system, the -- .

Col. 2, line 44, "preservation" should read -- preservative -- .

Col. 6, line 36 (Claim 2, line 6), "flowss reverse" should read -- flow reverses -- .

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*